United States Patent [19]

Smith, Jr.

[11] 4,148,635

[45] Apr. 10, 1979

[54] HIGH TEMPERATURE SOFTENING RESISTANCE OF ALLOY 688 AND MODIFIED 688 THROUGH THE ADDITION OF Nb

[75] Inventor: Warren F. Smith, Jr., Branford, Conn.

[73] Assignee: Olin Corporation, New Haven, Conn.

[21] Appl. No.: 857,389

[22] Filed: Dec. 5, 1977

Related U.S. Application Data

[63] Continuation-in-part of Ser. No. 839,822, Oct. 6, 1977, abandoned.

[51] Int. Cl.[2] ..... C22C 9/04

[52] U.S. Cl. ..... 75/157.5; 75/162; 148/13.2

[58] Field of Search ..... 75/157.5, 162; 148/13.2

[56] References Cited

U.S. PATENT DOCUMENTS

| | | | |
|---|---|---|---|
| 2,169,188 | 8/1939 | Kelly | 75/157.5 |
| 3,484,307 | 12/1969 | Eichelman et al. | 75/162 |
| 3,544,313 | 12/1970 | Sadoshima et al. | 75/157.5 |
| 3,703,367 | 11/1972 | Cocks | 75/157.5 |

FOREIGN PATENT DOCUMENTS

| | | | |
|---|---|---|---|
| 906786 | 8/1972 | Canada | 75/157.5 |
| 1050552 | 2/1959 | Fed. Rep. of Germany | 75/157.5 |

*Primary Examiner*—L. Dewayne Rutledge
*Assistant Examiner*—Upendra Roy
*Attorney, Agent, or Firm*—Paul Weinstein

[57] ABSTRACT

The improved high temperature softening resistance of Alloy 688 and modified 688 is obtained by the addition of niobium to the alloys. These particular alloy systems not only exhibit resistance to high temperature softening, but also exhibit improved stress corrosion and stress relaxation resistance properties. All of these properties are attained without any loss in the high strength properties of the base alloy systems.

10 Claims, 1 Drawing Figure

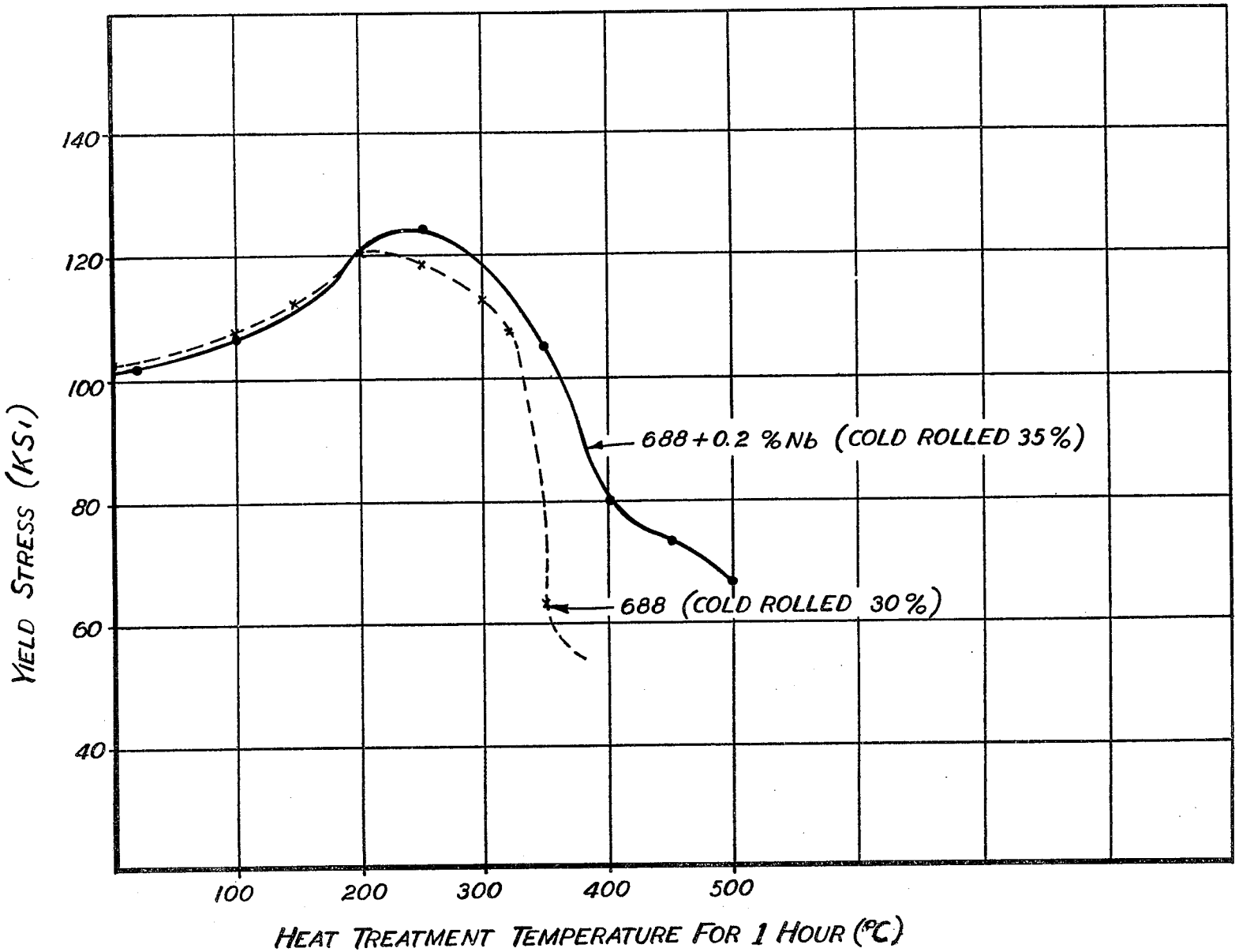
688+0.2 %Nb (COLD ROLLED 35%)
688 (COLD ROLLED 30%)
140
120
100
80
60
40
YIELD STRESS (KSI)
100
200
300
400
500
HEAT TREATMENT TEMPERATURE FOR 1 HOUR (°C)

HIGH TEMPERATURE SOFTENING RESISTANCE OF ALLOY 688 AND MODIFIED 688 THROUGH THE ADDITION OF NB

CROSS REFERENCE TO RELATED APPLICATION

This application is a Continuation-In-Part of copending application Ser. No. 839,822 by Warren F. Smith, Jr., for "Improving The High Temperature Softening Resistance of Alloy 688 Through The Additon of Nb", filed Oct. 6, 1977, now abandoned.

BACKGROUND OF THE INVENTION

Standard Alloy 688 (nominal composition of 73.5% Cu, 22.7% Zn, 3.4% Al and 0.4% Co) is a well-known copper base alloy for such purposes as springs, switches, contacts, relays and drawn and fabricated parts. This particular alloy exhibits an excellent combination of high strength and good formability. One problem which can be attributed to Alloy 688 is lower stress corrosion and stress relaxation properties compared to other alloys utilized for the same purposes.

It has been known that the stress corrosion and stress relaxation properties of Alloy 688 and modified 688 could be significantly improved if the alloy were subjected to low temperature thermal treatments after cold working. To attain maximum advantage of increased stress corrosion and stress relaxation resistance properties, this particular heat treatment should exceed a temperature of 280° C. This particular processing presents a further problem since Alloy 688 suffers from its disability to retain its full strength properties at temperatures higher than that necessary for the heat treatment. This disability is particularly evident at higher levels of cold deformation in processing this alloy. It can be seen that this problem makes it difficult or impossible to perform this particular type of heat treatment and also retain high strength in the cold deformed Alloy 688.

Accordingly, it is a principal object of the present invention to provide a method for increasing the high temperature thermal resistance of Alloy 688 and modified 688 without significantly affecting the strength properties of the alloys.

It is an additional object of the present invention to provide for such high temperature softening resistance as indicated above through the use of alloying additions rather than particular processing.

It is a further object of the present invention to alternately provide for improved stress corrosion and stress relaxation resistance in Alloy 688 and modified 688 by improving the high temperature softening resistance of the alloys.

Further objects and advantages of the present invention will become apparent from a consideration of the following specification.

SUMMARY OF THE INVENTION

These objects are accomplished in the present invention through the addition of niobium to standard Alloy 688 and modified 688. It has been found that the addition of niobium to standard Alloy 688 and modified 688 gives the alloys a significantly higher softening point than those alloys without niobium additions.

BRIEF DESCRIPTION OF THE DRAWINGS

The drawing FIGURE is a graph indicating the difference in remaining yield strength (ksi) after being held at temperature (° C.) for one hour for both niobium-containing standard Alloy 688 and standard Alloy 688.

DETAILED DESCRIPTION

An increase in the high temperature softening resistance of standard Alloy 688 and modified 688 is provided by the addition of niobium within the range of 0.02 to 1.0% by weight to the alloys. The other elements within the alloys must also be present within the specific ranges. The copper content of the alloys should fall within the range of 66 to 80% by weight and preferably from 70 to 76% by weight. If the percentage of copper within the specific alloy is above 76 to 80% by weight, the strength of the final alloy suffers markedly and if the percentage of copper is below 66% by weight, an additional phase forms in the alloy which limits the ductility of the alloy. The zinc content of the alloys should be within the range of 15 to 32.5% by weight and preferably from 19 to 29% by weight. The aluminum content should range from 1 to 5% by weight and preferably from 2 to 4.5% by weight. The element selected from the group consisting of cobalt, nickel, iron, chromium and titanium is present in the alloys at a much lower percentage range than the other elements, namely from 0.1 to 3% by weight for each of cobalt, titanium and chromium, from 0.2 to 5% by weight nickel and from 0.2 to 1.5% by weight iron. The preferred percentage ranges for these elements are from 0.1 to 1.5% by weight for each of chromium and titanium, from 0.1 to 1% by weight cobalt, from 0.4 to 2% by weight nickel and from 0.2 to 1% by weight iron. The amount of additional element present in the alloy determines the eventual ductility of the alloy since the preferred weight range for each element gives the highest ductility values while the higher weight range for each element generally lowers the ductility of the alloy. Little improvement in the physical properties of the alloy is realized above the upper weight percentage for each element since the excess element within the alloy appears as elemental metal particles or as massive element-aluminum intermetallic compounds.

Generally, the alloys containing lower amounts of these elemental additions are high strength, high ductility materials while the alloys containing higher amounts of these elements provide even higher strength properties but lower the ductility of the alloy. Apparently, there is a trade-off within the alloy between high strength and ductility. For example, in those alloys containing either cobalt, chromium or titanium additions, the aluminum content within the alloy should be in the range of 1.2 to 3.2% by weight at approximately the 69% by weight level for copper in order to insure a combination of high ductility and high strength in the alloy. For those alloys containing iron, the aluminum content should be in the range of 1.5 to 3.1% by weight at the 69% by weight level for copper. The nickel-containing alloys should contain 1.5 to 4.0% by weight aluminum at approximately the 71.5% by weight copper level. At the 74% by weight concentration for copper within those alloys containing either cobalt, chromium or titanium, the aluminum content should be in the range of 3 to 5% by weight for the same reasons. At this same copper level in the nickel-containing alloy, the aluminum content should range from 2.5 to 5.0% by weight. At the 75 weight percent concentration for copper in the iron-containing alloy, the aluminum content should range from 3.5 to 5% by weight. Proportional adjustments of aluminum within the alloys for the various copper contents within the noted ranges should preferably be made for a combination of high strength and high ductility. Furthermore, this aluminum content should also be related to the zinc content within the alloys in order to achieve the desired combination of ductility and strength.

The alloys of the present invention may include conventional impurities typically found in similar copper base alloys. Additionally, other alloying ingredients may be added to the base system to achieve particular results. Such ingredients, in impurity levels, may include lead, tin, phosphorus, iron, manganese, nickel and silicon. For minimizing dezincification in corrosive environments, such elements as arsenic, antimony and phosphorus, or combinations thereof, in amounts ranging from 0.02 to 0.1% by weight may be added to the alloys.

Processing of the alloy system requires no unusual treatment. Melting and casting of the alloy may be performed under similar conditions as with commercially available brass alloys. Direct chill (DC) casting is particularly suitable for casting the alloy system of the present invention. Hot working of this alloy system is easily accomplished using normal brass mill techniques. Under rapid cooling conditions, a non-equilibrium structure may be obtained in the alloy which reduces the initial cold workability of the alloy. This may be overcome by annealing the specific alloy to obtain approximate equilibrium proportions of alpha and beta phases within the alloy.

Further objects and advantages of the present invention will become more apparent from a consideration of the following illustrative example.

EXAMPLE

Standard Alloy 688 (i.e., containing cobalt as an elemental addition) and standard Alloy 688 with the addition of 0.2% by weight niobium were both subjected to a one hour heat treatment at each of the temperatures shown in the drawing. The drawing clearly illustrates that for the useful high strength range (above 60 ksi yield strength), there is at least a 30° C. average increase in the softening point for the niobium-containing 688 than for the standard Alloy 688. It should be noted in this example that the niobium-containing 688 sample received a 35% reduction in cold working while the standard Alloy 688 received a 30% reduction in cold working. The standard Alloy 688 had a 0.2% offset yield strength of 104 ksi, an ultimate tensile strength of 117 ksi and an elongation of 1% in a 2" gage length. The niobium-containing Alloy 688 had respective values for yield strength, ultimate tensile strength and elongation of 102 ksi, 123 ksi and 6% respectively. It should be remembered that Alloy 688 has suffered from its ability to retain its strength at high temperatures, especially at higher levels of cold deformation. Therefore, the high temperature softening resistance improvement exhibited by the niobium-containing alloy of the present invention is all the more remarkable because of its higher cold deformation. The drawing figure further indicates for example, that at 350° C., the niobium-containing Alloy 688 has strength properties slightly higher than the original cold rolled strength while the standard Alloy 688 has softened almost to an annealed condition.

While it is usually true that an alloy which has undergone cold deformation exhibits a decrease in thermal softening resistance with increases in the amount of deformation applied, it can be seen that the niobium-containing Alloy 688 selected from the alloy systems of the present invention does not exhibit such a decrease in softening resistance even though it received a 35% reduction in the cold working of the example while the standard Alloy 688 only received a 30% reduction in cold working. Alloy 688 which has been deformed to a high strength temper could not be thermally treated to improve stress corrosion or stress relaxation resistance properties without significant softening of the alloy taking place. Niobium-containing Alloy 688 would, at the same temperatures, retain the combination of high strength, high stress corrosion resistance and high stress relaxation resistance.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy which exhibits improved resistance to softening at high temperatures as well as improved stress corrosion and stress relaxation resistance properties, said alloy consisting essentially of from 66 to 80% by weight copper, from 15 to 32.5% by weight zinc, from 1 to 5% by weight aluminum, an element selected from the group consisting of 0.1 to 3% by weight for any of cobalt, titanium and chromium, 0.2 to 5% by weight nickel and 0.2 to 1.5% by weight iron, and from 0.02 to 1% by weight niobium.

2. An alloy according to claim 1 wherein said copper is present in an amount ranging from 70 to 76% by weight.

3. An alloy according to claim 1 wherein said zinc is present in an amount ranging from 19 to 29% by weight.

4. An alloy according to claim 1 wherein said aluminum is present in an amount ranging from 2 to 4.5% by weight.

5. An alloy according to claim 1 wherein said cobalt is present in an amount ranging from 0.1 to 1% by weight.

6. An alloy according to claim 1 wherein any of said titanium and chromium is present in an amount ranging from 0.1 to 1.5% by weight.

7. An alloy according to claim 1 wherein said nickel is present in an amount ranging from 0.4 to 2% by weight.

8. An alloy according to claim 1 wherein said iron is present in an amount ranging from 0.2 to 1% by weight.

9. An alloy according to claim 1 wherein the alloy further includes an addition in an amount ranging from 0.02 to 0.1% by weight of an element selected from the group consisting of arsenic, antimony and phosphorus, or combinations thereof.

10. A copper base alloy consisting essentially of 70 to 76% by weight copper, 19 to 29% zinc, 2 to 4.5% aluminum, 0.1 to 1% cobalt, and 0.02 to 1% by weight niobium.

* * * * *